US011103399B2

(12) United States Patent
Shimizu et al.

(10) Patent No.: US 11,103,399 B2
(45) Date of Patent: Aug. 31, 2021

(54) ASSISTANCE DEVICE

(71) Applicant: FUJI CORPORATION, Chiryu (JP)

(72) Inventors: Satoshi Shimizu, Chiryu (JP); Takehiro Noguchi, Ama (JP); Takehiro Hiraoka, Chiryu (JP)

(73) Assignee: FUJI CORPORATION, Chiryu (JP)

( * ) Notice: Subject to any disclaimer, the term of this patent is extended or adjusted under 35 U.S.C. 154(b) by 266 days.

(21) Appl. No.: 16/330,170

(22) PCT Filed: Sep. 13, 2016

(86) PCT No.: PCT/JP2016/076950
§ 371 (c)(1),
(2) Date: Mar. 4, 2019

(87) PCT Pub. No.: WO2018/051405
PCT Pub. Date: Mar. 22, 2018

(65) Prior Publication Data

US 2019/0183706 A1 Jun. 20, 2019

(51) Int. Cl.
*A61G 7/053* (2006.01)
*A61G 7/10* (2006.01)
(Continued)

(52) U.S. Cl.
CPC ..... *A61G 7/0533* (2013.01); *A61G 5/14* (2013.01); *A61G 7/015* (2013.01); *A61G 7/1017* (2013.01);
(Continued)

(58) Field of Classification Search
CPC ..... A61G 5/14; A61G 7/0533; A61G 7/015; A61G 7/1046; A61G 2200/34; A63B 2220/50; A61B 5/1036
See application file for complete search history.

(56) References Cited

U.S. PATENT DOCUMENTS 8,856,981 B1 10/2014 Rayess et al.
9,295,597 B2 3/2016 Hjort et al.
(Continued)

FOREIGN PATENT DOCUMENTS

CN 102688130 A 9/2012
JP 2008-86586 A 4/2008
(Continued)

OTHER PUBLICATIONS

International Search Report dated Dec. 6, 2016 in PCT/JP2016/076950 filed Sep. 13, 2016.
(Continued)

*Primary Examiner* — Eric J Kurilla
*Assistant Examiner* — James T Coble
(74) *Attorney, Agent, or Firm* — Oblon, McClelland, Maier & Neustadt, L.L.P.

(57) ABSTRACT

An assistance device that enables appropriate evaluation of to what extent a care receiver is using their own leg power. The assistance device is provided with: a body supporting member configured to support the upper body of the care receiver; a first load detecting device provided on the body supporting member, and configured to detect a first load applied by the care receiver; a second load detecting apparatus provided on the body supporting member at a position rearwards of the first load detecting device, and configured to detect a second load applied by the care receiver; and an effort level calculating device configured to calculate effort levels representing to what extent the care receiver is using their own leg power during the standing assistance based on a relationship between the first load and the second load.

11 Claims, 6 Drawing Sheets

(51) Int. Cl.
*A61G 5/14* (2006.01)
*A61G 7/015* (2006.01)

(52) U.S. Cl.
CPC ..... *A61G 7/1019* (2013.01); *A61G 7/1046* (2013.01); *A61G 2200/34* (2013.01); *A61G 2203/44* (2013.01)

(56) References Cited

U.S. PATENT DOCUMENTS

| | | | | |
|---|---|---|---|---|
| 10,045,895 | B2 * | 8/2018 | Eklof | A61G 7/1046 |
| 2014/0289959 | A1 * | 10/2014 | Hjort | A61G 7/1019 5/83.1 |
| 2017/0014290 | A1 | 1/2017 | Tsusaka et al. | |

FOREIGN PATENT DOCUMENTS

| | | | |
|---|---|---|---|
| JP | 2016-64124 | A | 4/2016 |
| WO | WO 2013/028961 | A1 | 2/2013 |

OTHER PUBLICATIONS

Extended European Search Report dated Aug. 19, 2019 in corresponding European Patent Application No. 16916190.8, 6 pages.
Office Action dated Jul. 22, 2019 in corresponding Australian Patent Application No. 2016423310 (with English Translation), 3 pages.
Singaporean Search Report dated Apr. 28, 2020 in Singaporean Patent Application No. 1101901626Y, 3 pages.
Singaporean Written Opinion dated Apr. 29, 2020 in Singaporean Patent Application No. 1101901626Y, 4 pages.

* cited by examiner

ASSISTANCE DEVICE

TECHNICAL FIELD

The present application relates to an assistance device.

BACKGROUND ART

It is hoped that an assistance device that performs standing assistance for a care receiver also improves the ability of the care receiver to stand up using their own leg power. Thus, for a device that performs standing assistance for a care receiver, patent literature 1 and 2 disclose identifying to what extent the care receiver is using their own leg power (to what extent the care receiver is relying on the device).

An assistance device disclosed in patent literature 1, when performing standing assistance in a state with a part of the body of the care receiver held by a support member capable of being raised and lowered, determines the level of reliance by the care receiver on the device based on a load of a motor required to raise the support section. Further, an assistance device disclosed in patent literature 1 reports information visually or aurally in accordance with the level of reliance. Also, the assistance device reports messages of encouragement by comparing the current level of reliance with historical data of past levels of reliance.

Disclosed in patent literature 2 is being able to check how much force is being applied to an arm mechanism of an assistance device by using a detection section to detect force applied by a care receiver to the arm mechanism and displaying a detected value on, for example, a monitor or the like provided on the arm mechanism. In this case, a larger force applied means that the care receiver is not using their lower body, thus, for example, it is possible for the care receiver to check their rehabilitation progress themselves. Further, by comparing with past force information that has been memorized, it is possible to check how much effect rehabilitation has had since previously.

CITATION LIST

Patent Literature

Patent literature 1: JP-A-2008-86586
Patent literature 2: JP-A-2016-64124

BRIEF SUMMARY

Technical Problem

However, it is difficult to evaluate the reliance of a care receiver on an assistance device simply by outputting a load on an arm mechanism or a load on a motor used to raise a support member that supports a body part of the care receiver. For example, for the same load applied to a support member, depending on the physique of the care receiver, the level of reliance of the care receiver on the assistance device may differ. Thus, it is desirable to be able to appropriately evaluate to what extent a care receiver is using their own leg power (a first problem).

Also, during standing assistance by the assistance device, a care receiver may use their own leg power at various different times. A care receiver may use their own leg lower, for example, immediately after the start of standing assistance, during standing assistance, or immediately before the end of standing assistance. With technology disclosed in patent literature 1, sufficient evaluation is not achieved in terms of identifying to what extent a care receiver is using their own leg power in cases in which the timing varies for the use of leg power during a series of standing operations. Thus, it is desirable to be able to appropriately evaluate to what extent a care receiver is using their own leg power in cases in which the timing varies for the use of leg power (second problem).

An object of the present invention is to provide an assistance device that solves the above first or second problem.

Solution to Problem

An assistance device of the present disclosure is for supporting an upper body of a care receiver and performing standing assistance for the care receiver, the assistance device including: a base; a body supporting member provided on the base in a manner capable of being raised and lowered, and configured to support the upper body of the care receiver; a first load detecting apparatus provided on the body supporting member, and configured to detect a first load applied by the care receiver; a second load detecting apparatus provided on the body supporting member at a position rearwards of the first load detecting apparatus, and configured to detect a second load applied by the care receiver; and an effort level calculating device configured to calculate an effort level representing to what extent the care receiver is using their own leg power during the standing assistance based on a relationship between the first load and the second load.

The effort level calculating device calculates an effort level of the care receiver based on a relationship between the first load and the second load. A caregiver or the care receiver is able to understand a way in which load is applied in the front-rear direction of the body supporting member from the first load and the second load. For example, a way in which load is applied may be a load towards the front, a load towards the rear, a load balanced between the front and rear, and so on. Here, with respect to a way in which load is applied in the front-rear direction of the body supporting member, in a case in which the extent to which the care receiver is using their own leg power (effort level) is high, the ratio of the body weight of the care receiver supported by their own legs increases, therefore, the rear-side load on the body supporting member decreases, and the load is a forward load. Conversely, with respect to a way in which load is applied in the front-rear direction of the body supporting member, in a case in which the extent to which the care receiver is using their own leg power (effort level) is low, the ratio of the body weight of the care receiver supported by their own legs decreases, therefore, the rear-side load on the body supporting member increases, and the load is a rearward load. The relationship between this way in which a load is applied on the body supporting member in the front-rear direction and the dependency level of the care receiver on the assistance device shows a similar trend regardless of differences in physiques of care receivers. In other words, by calculating the effort level based on the first load and the second load it is possible to appropriately evaluate to what extent the care receiver used their own leg power.

Also, an assistance device of the present disclosure is for supporting an upper body of a care receiver and performing standing assistance for the care receiver, the assistance device including: a base; a body supporting member provided on the base in a manner capable of being raised and lowered, and configured to support the upper body of the care receiver; a load detecting device configured to detect a load applied on the body supporting member by the care receiver; and an effort level calculating device configured to calculate effort level reference data for a specified period representing to what extent the care receiver is using their own leg power during the standing assistance based on the load, and calculate a maximum value of the effort level reference data as the effort level. Accordingly, it is possible to understand the effort level of the care receiver for the time at which they maximized use of their own leg power during a specified period.

DESCRIPTION OF EMBODIMENTS

Configuration of Assistance Device

Figure 1:
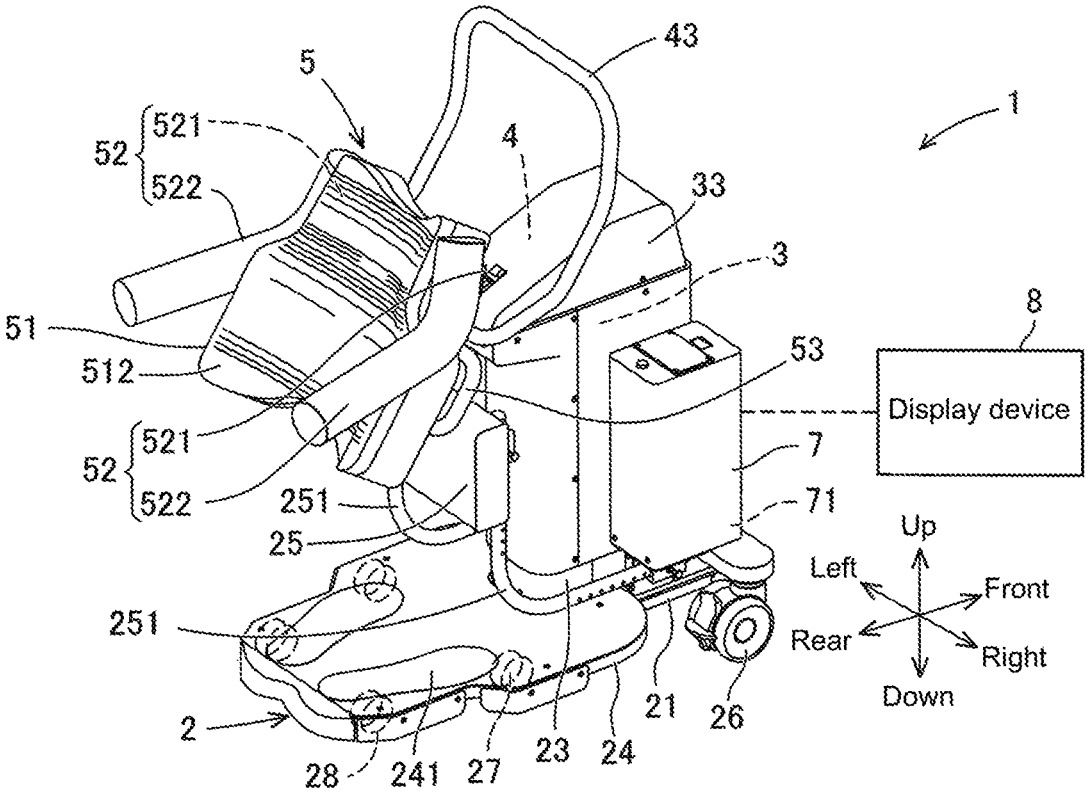
FIG. 1 is a perspective view of an assistance device seen diagonally from the rear in a state in which a care receiver is to get on in a sitting posture.

Assistance device 1 that assists a care receiver to move is described with reference to FIGS. 1 and 2. In the present disclosure, assistance device 1 is given as an example of a device that performs standing assistance and sitting assistance, but a device that performs other types of assistance may also be applied.

Assisting device 1 supports the upper body of care receiver M and assists care receiver M in standing up from a sitting posture to a standing posture. Further, assistance device 1 supports the upper body of care receiver M and assists care receiver M in sitting down from a standing posture to a sitting posture. Thus, assistance device 1 is capable of assisting care receiver to move and transfer somewhere.

A "standing posture" refers to a posture in which the lower body of care receiver M is upright, regardless of the posture of the upper body. That is, standing assistance is assistance for moving the position of the buttocks of care receiver M upwards. Further, sitting assistance is assistance for moving the position of the buttocks of care receiver M downwards.

Assistance device 1 is provided with base 2, raising and lowering section 3, oscillating section 4, body supporting member 5, load detection device 6, control unit 7, and display device 8. Base 2 includes frame 21, support column 22 (refer to FIG. 2), fixed cover 23, footrest 24, lower limb contacting section 25, and six wheels 26 to 28. Frame 21 is provided near floor surface F in a substantially horizontal manner. Support column 22 is provided upright on frame 21 towards the front and in the center in the left-right direction. Raising and lowering device section 32, described later, is provided inside support column 22 with a substantially rectangular cross section. Fixed cover 23 covers and protects support column 22 and around a lower section of raising and lowering member 31, which is described later.

Footrest 24 is fixed towards the rear of an upper surface of frame 21 in a substantially horizontal manner. Foot-shaped contact marks 241 indicating a position for the feet of care receiver M are provided on an upper surface of footrest 24. Lower limb contacting section 25 is arranged above and slightly to the front of contact marks 241 and is formed by a pair of L-shaped left and right support arms 251 and 251. Lower limb contacting section 25 is arranged straddling the upright portions of the left and right support arms 251 extending in the left-right direction. Lower limb contacting section 25 is a portion for the lower limbs of care receiver M to contact and is made of a cushion material. The arrangement height of lower limb contacting section 25 can be adjusted.

Three wheels, 26 to 28, are provided respectively on both the left and right sides on a lower side of frame 21. Each of the wheels 26 to 28 has a steering function for changing the movement direction and at least front wheels 26 have a locking function for restricting movement. Due to the steering function of the six wheels 26 to 28, assisting device 1 is not only capable of moving in a front-rear direction and changing directions but is capable of moving laterally (moving directly to the side) and spinning (rotating on the spot).

Raising and lowering section 3 is configured from items such as raising and lowering member 31, raising and lowering drive section 32, and raising and lowering cover 33. Raising and lowering member 31 is elongated in the up-down direction and supported on the rear surface of support column 22 to be movable up and down. In the present embodiment, raising and lowering member 31 moves up and down by vertically moving with respect to support column 22, but may also be made to move up and down by pivoting with respect to support column 22.

An upper section of raising and lowering member 31 protrudes to the rear and oscillating support section 34 is provided towards the end that protrudes to the rear. Oscillating drive section 42 is provided inside an upper portion of raising and lowering member 31. Raising and lowering drive section 32 arranged inside support column 22 drives the up-down movement of raising and lowering member 31. Raising and lowering cover 33 covers and protects raising and lowering member 31 and the upper part of support column 22. Raising and lowering cover 33 is attached to raising and lowering member 31 and moves up and down with raising and lowering member 31. A lower portion of raising and lowering cover 33 that moves up and down always overlaps an outside portion of fixed cover 23.

Oscillating section 4 includes oscillating member 41, oscillating drive section 42, and first handle 43. Oscillating member 41 is formed in an arm shape. Oscillating member 41 is provided to be capable of oscillating in a front-rear direction with respect to raising and lowering member 31. Specifically, an end of oscillating member 41 is supported by oscillating support section 34 of raising and lowering member 31 to be capable of oscillating. Oscillating drive section 42 provided inside an upper portion of raising and lowering member 31 oscillates an end of oscillating member 41 in the front-rear direction around the other end of oscillating member 41.

First handle 43 is provided integrally with the other end of oscillating member 41. First handle 43 is a roughly rectangular frame. First handle 43 extends in the front upper direction from the other end of oscillating member 41. The sides of first handle 43 are gripped by both hands of care receiver M. Further, the sides and front of first handle 43 are gripped by a caregiver to move assistance device 1.

Body supporting member 5 includes items such as torso support member 51, underarm support members 52 and 52, and second handle 53. Torso support member 51 includes support main body 511 and cushion 512. Support main body 511 is made of metal and is plate-shaped. The front underside of support main body 511 is supported by the other end of oscillating member 41. Accordingly, support main body 511 can be tilted in a front-rear direction with respect to raising and lowering member by oscillating drive section 42.

Further, support main body 511 is supported in a free-tilting manner in the front-rear direction with respect to oscillating member 41. Support main body 511 is capable of tilting within a predetermined angle range in the clockwise direction of FIG. 2 from the state shown in FIG. 2. It should be noted that free-tilting does not refer to tilting driven by an actuator or the like but tilting that is done manually.

Cushion 512 is fixed to the upper rear side of support main body 511. Cushion 512 is formed from a material that easily changes shape and has a surface that closely matches the shape of the torso of care receiver M. The support surface of cushion 512 makes contact with and supports the front surface of the torso of care receiver M. In particular, cushion 512 supports a portion ranging from the chest to the abdomen of care receiver M from below.

Underarm support members 52 and 52 are provided on the left and right sides of torso support member 51. Underarm support member 52 includes a support main body 521 and an underarm arm 522. Support main body 521 of underarm support member 52 is made of metal and is supported by support main body 511 of torso support member 51 to be capable of oscillating. Underarm arm 522 supports an underarm of care receiver M. Underarm arm 522 is a rod-shaped member formed into an L-shape. The surface of underarm arm 522 is covered with a material that can flexibly deform.

Second handle 53 is integrally provided on the front surface of support main body 511 of torso support member 51. Second handle 53 is U-shaped elongated in the horizontal direction. Second handle 53 includes a base shaft fixed to the lower end of support main body 511 and extending in a left-right direction, and a gripping portion extending from both ends of the base shaft toward first handle 43.

Figure 2:
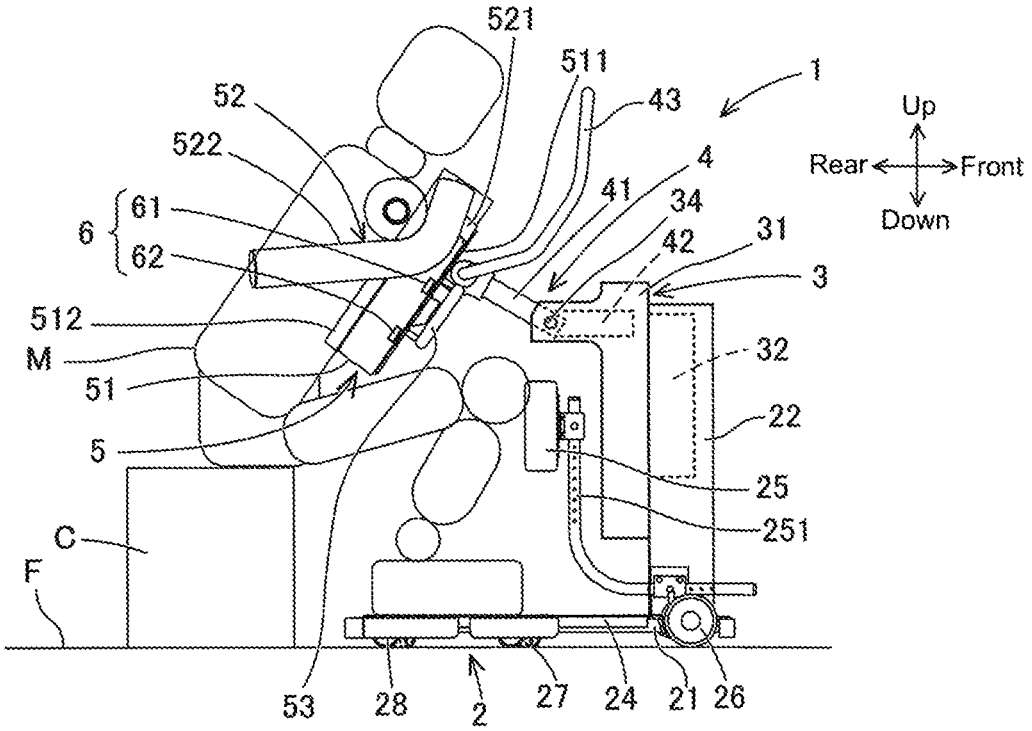
FIG. 2 is a side view of the assistance device of FIG. 1 also showing a care receiver in a sitting posture when standing assistance is to start.

As shown in FIG. 2, loading detecting device 6 is attached to torso support member 51 and is for detecting a load applied by the upper body of care receiver M. Load detecting device 6 is attached to an upper surface of support main body 511 and is sandwiched between support main body 511 and cushion 512. Load detecting device 6 includes first load detecting apparatus 61 and second load detecting apparatus 62.

First loading detecting device 61 is provided near a central position in the up-down direction (front-rear direction) of support main body 511. First load detecting apparatus 61 corresponds to a first portion (for example, near the chest) of the upper body of care receiver M. First loading detecting device 61 detects first load a applied by care receiver M. First load detecting apparatus 61 continuously acquires first load a during a specified sampling time while the power to assistance device 1 is turned on. There are two first load detecting apparatuses 61 arranged separated on the left and right.

Second load detecting apparatus 62 is provided below and to the rear of first load detecting apparatus 61. Second load detecting apparatus 62 corresponds to a second portion (for example, near the abdomen) of the upper body of care receiver M that is below and to the rear of the first portion of the upper body of care receiver M. Second load detecting apparatus 62 detects second load b applied by care receiver M. Second load detecting apparatus 62 continuously acquires second load b during a specified sampling time while the power to assistance device 1 is turned on. There are two second load detecting apparatuses 62 arranged separated on the left and right.

Control unit 7 is provided on an upper right side of frame 21. Control unit 7 includes control device 71 that controls raising and lowering drive section 32 and oscillating drive section 42. Control device 7 controls raising and lowering drive section 32 and oscillating drive section 42 based on instructions from care receiver M or a caregiver. A computer running software may be used as control device 7. The computer may be provided with a remote control, not shown, for receiving instructions from care receiver M or the caregiver. A standing-assistance program for assisting in standing and a sitting-assistance program for assisting in sitting may be stored as executable software. A rechargeable battery pack, reference numeral omitted, is attached to the lower side of control device 71. The battery pack is also attached to the top left side of frame 21. The battery pack is also shared with raising and lowering drive section 32 and oscillating drive section 42.

Display device 8 includes a display screen that displays various items of information to a caregiver or care receiver M. In the present embodiment, display device 8 displays items such as effort level, Da, Da_max, and Da_ave, which are described later. The effort level represents to what extent care receiver M is using their own leg power.

Here, display device 8 may be provided integrally with a main body item of the assistance device (2, 3, 4, 5, 6, or 71). In this case, display device 8 may be attached to oscillating section 4 or body supporting member 5, or may be attached to control unit 7. Note that, main body items of the assistance device include base 2, raising and lowering section 3, oscillating section 4, body supporting member 5, load detecting device 6, and control device 71.

Also, display device 8 may be provided separately to main body items of the assistance device (2, 3, 4, 5, 6, or 71). In this case, display device 8 may acquire data via wireless communication with control unit 7 to display the various information. Display device 8 may be a computer or mobile terminal such as a tablet or smartphone. Display device 8, even when not near a main body item of the assistance device (2, 3, 4, 5, 6, or 71), may acquire various information from control unit 7 and display the acquired information.

Assistance Operation of Assistance Device 1

Figure 3:
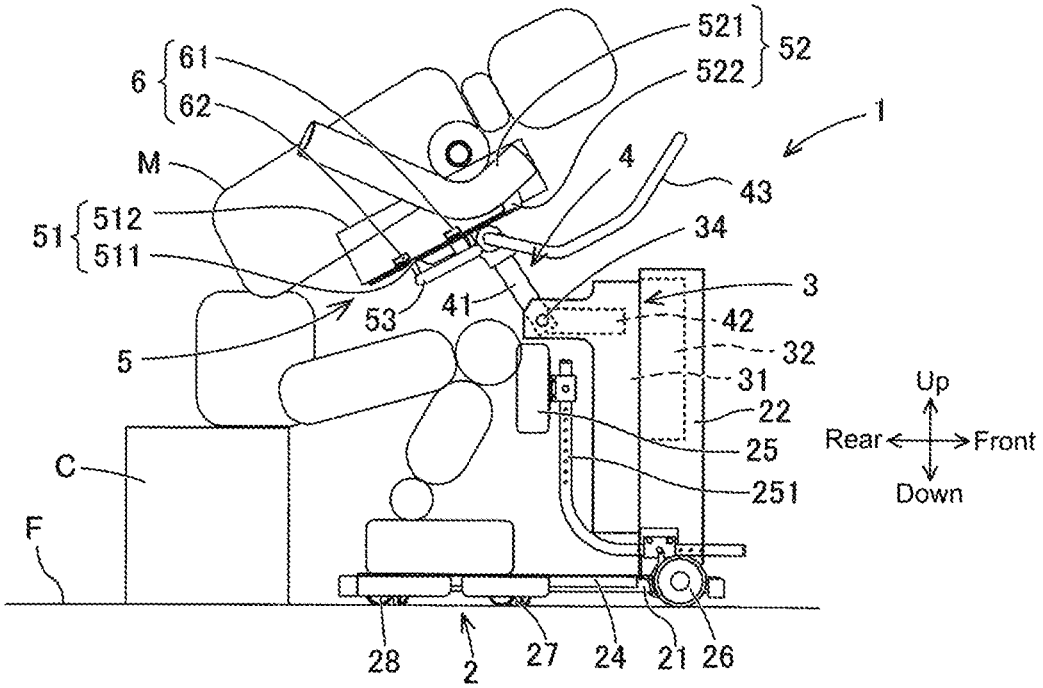
FIG. 3 is a side view of the assistance device in a state moved to a standing preparation posture with the care receiver also shown in a standing preparation posture.
Figure 4:
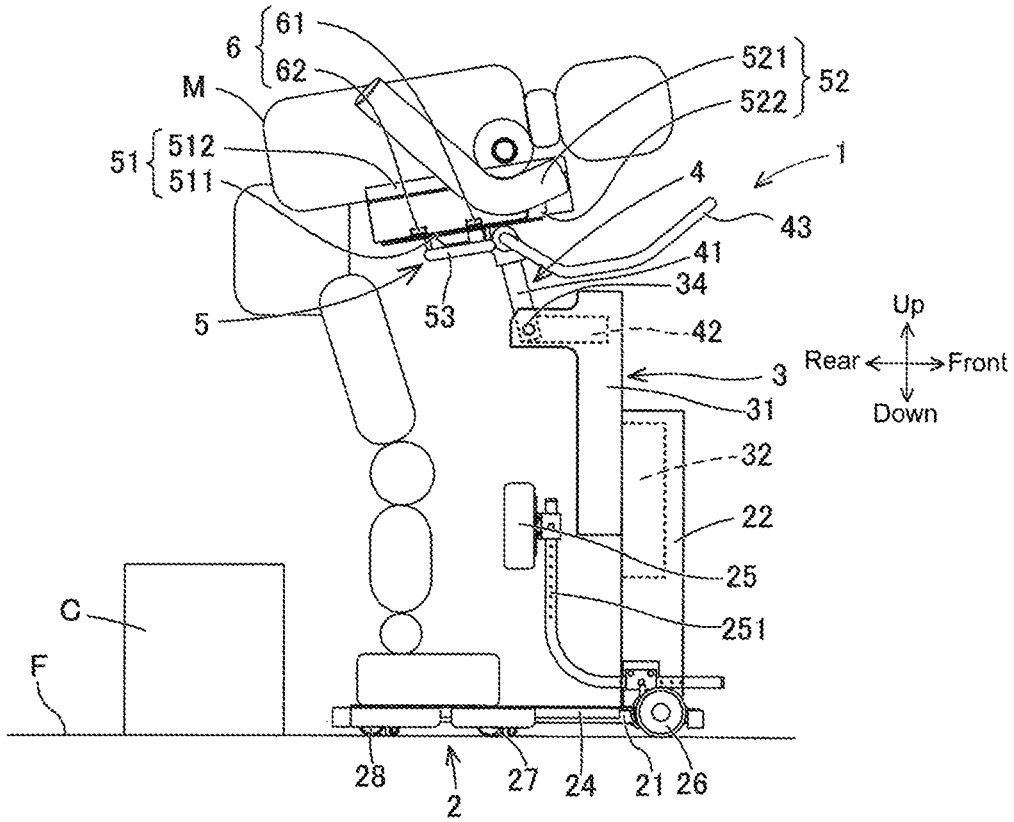
FIG. 4 is a side view of the assistance device in a state moved to a standing posture with the care receiver also shown in a standing posture.

Standing assistance of assistance device 1 is described next with reference to FIGS. 2 to 4. With standing assistance, assistance device 1 has a starting state as shown in FIG. 2, then assumes a standing preparation state as shown in FIG. 3, then a standing complete state as shown in FIG. 4.

First, a caregiver moves assistance device 1 close to care receiver M in a sitting posture. Here, as shown in FIG. 2, a caregiver moves assistance device 1 such that a care receiver M in a sitting posture can get on assistance device 1. Also, the caregiver adjusts the height of raising and lowering member 31 in accordance with the height of care receiver M. Continuing, care receiver M puts both legs under body supporting member 5. If body supporting member 5 is in the way, care receiver M or the caregiver can raise the lower end of body supporting member 5 manually to allow care receiver M to easily insert their legs under body supporting member 5.

Next, care receiver M places both feet on contact marks 241 and brings their lower legs in contact with lower limb contacting section 25. Further, care receiver M places their torso on the support surface of cushion 512 of torso support member 51. That is, the upper body of care receiver M is in a posture tilted slightly forward and supported by body supporting member 5. At the same time, care receiver M inserts underarm arms 522 under their arms. In this manner, assistance device 1 is set to the starting state of standing assistance. Then, the caregiver allows care receiver M to grip first handle 43. The posture of care receiver M at this time is the starting posture of standing assistance.

Continuing, the caregiver starts driving of assistance device 1 based on the standing assistance program of assistance device 1. By this, raising and lowering of raising and lowering member 31 is performed in conjunction with tilting forwards of oscillating member 41.

When the standing assistance program is performed, assistance device 1 enters the standing preparation state shown in FIG. 3. The standing preparation state of assistance device 1 is the state directly before care receiver M in the sitting posture is lifted from seat C. In other words, assistance device 1, from the starting state shown in FIG. 2, lowers raising and lowering member 31 and tilts oscillating member 41 forward to enter the standing preparation state shown in FIG. 3. Here, when assistance device 1 is in the standing preparation state, the buttocks of care receiver M are in contact with the seat surface of seat C and their torso is tilted forward and extended. The posture of care receiver M at this point is referred to as the standing preparation posture.

When the standing assistance program is continued, as shown in FIG. 4, raising and lowering member 31 is raised and oscillating member 41 is tilted forward further and then the standing assistance program ends. Upon this, care receiver M has changed from the standing preparation posture to a standing posture. In other words, the upper body of care receiver M in the standing posture tilts forwards a large amount and the position of the buttocks of care receiver M is higher than the seat surface of seat C. The legs of care receiver M are almost fully extended.

In this manner, after care receiver M has got onto assistance device 1 and torso support member 51 has been tilted forwards, care receiver M transfers from the starting posture of a sitting posture to a standing posture via the standing preparation posture.

Sitting assistance of assistance device 1 is performed by essentially performing a reverse operation of standing assistance. That is, by tilting torso support member 51 backwards while lowering raising and lowering member 31, care receiver M can move from a standing posture to a sitting posture. And, care receiver M in the sitting posture can easily remove their arms from underarm arms 522.

Detailed Configuration of Control Unit 7

Figure 5:
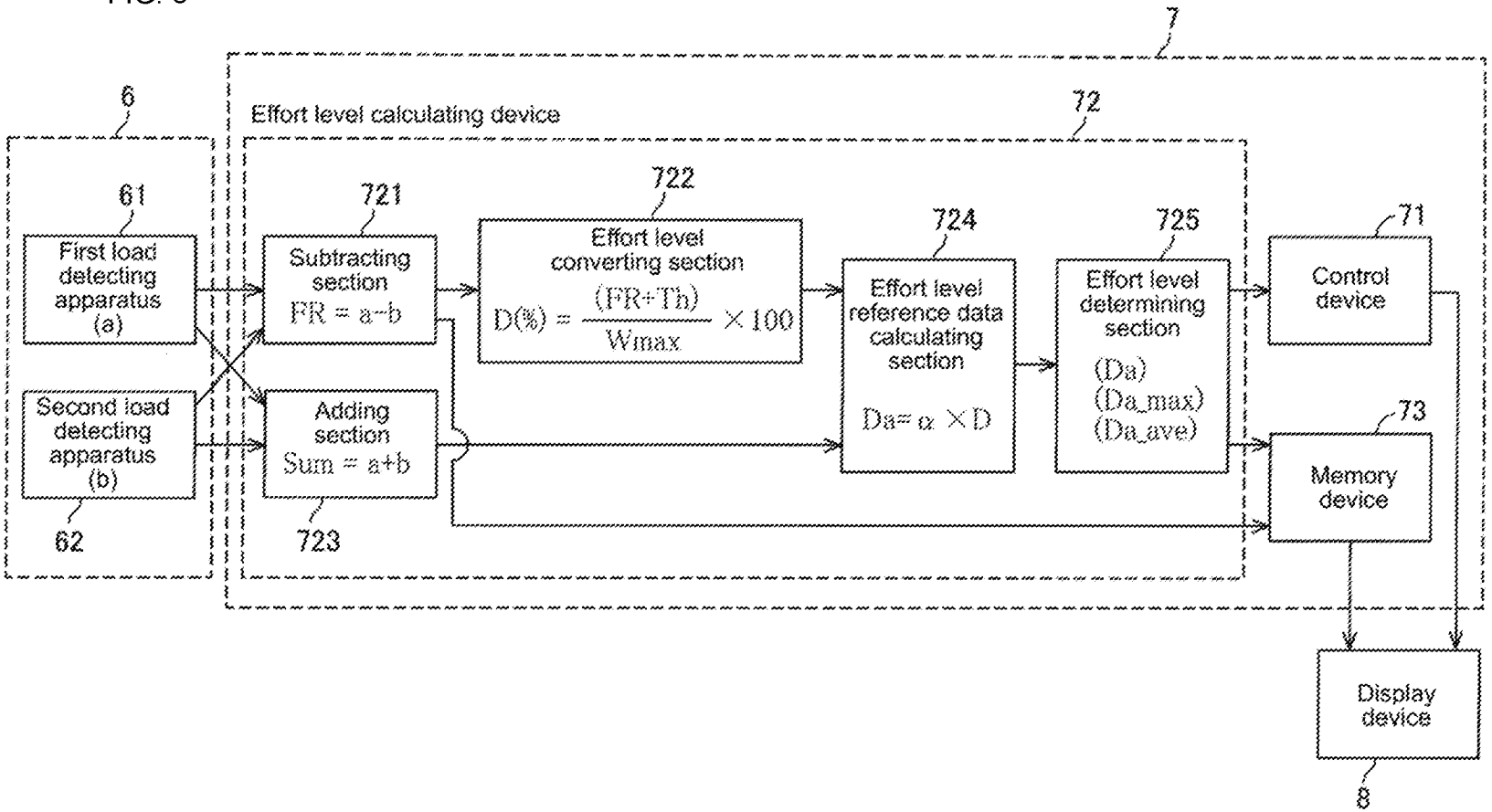
FIG. 5 shows the configuration of control unit 7.

The detailed configuration of control unit 7 will be described next with reference to FIGS. 5 to 6. As shown in FIG. 5, control unit 7 is provided with control device 71, effort level calculating device 72, and memory device 73. Descriptions of contents of the above control device 71 are omitted here.

Effort level calculating device 72 calculates effort level Da, Da_max, and Da_ave that represent to what extent care receiver M is using their own leg power based on a relationship between first load a and second load b during operation of the assistance device. In the present embodiment, effort level calculating device 72 calculates effort level Da, Da_max, and Da_ave using the difference between first load a and second load b and the sum of first load a and second load b as the relationship between first load a and second load b.

Here, effort level Da, Da_max, and Da_ave represent to what extent care receiver M is using their own leg power, and therefore correspond to the reciprocal of the dependency level of care receiver M on assistance device 1. For example, if effort level Da, Da_max, and Da_ave are 100%, care receiver M is standing up using only their own leg power, so there is no assistance from assistance device 1. On the other hand, if the effort level values are 0%, care receiver M is not using their own leg power at all and is standing up based entirely on assistance from assistance device 1.

In the present embodiment, effort level Da, Da_max, and Da_ave are represented as a percentage, but they may be represented as multiple types (for example, four or five types) indicating a degree of highness or lowness. In the present embodiment, first effort level Da is effort level reference data Da as is, second effort level Da_max is the maximum value of effort level reference data Da, and third effort level Da_ave is the average value of effort level reference data Da. It is possible to use only one of the above three types as the effort level.

Effort level calculating device 72 is provided with subtracting section 721, effort level converting section 722, adding section 723, effort level reference data calculating section 724, and effort level determining section 725. Subtracting section 72 acquires first load a and second load b. Here, as described above, first load a and second load b are acquired at a specified sampling time after the power of assistance device 1 is turned on. That is, first load a and second load b are acquired not only at the starting state and the end state of standing operation, but are also acquired before entering the starting state of standing assistance and after the completion of standing.

Then, subtracting section 721 calculates subtraction value FR that is the difference between first load a and second load b. The timing for calculating the subtraction value by subtracting section 721 may be to match the specified sampling time of acquiring or may be a time longer than the specified sampling time.

Here, subtraction value FR is second load b subtracted from first load a (a−b). In other words, in a case in which the load of the upper part (chest part) of care receiver M is larger than the load of the lower part (near the abdomen), subtraction value FR is positive. On the other hand, in a case in which the load of the upper part (chest part) of care receiver M is smaller than the load of the lower part (near the abdomen), subtraction value FR is negative.

Also, in a case in which care receiver M is using their own leg power, regardless of their physique, first load a in a forwards direction is larger than second load b in a rearwards direction. On the other hand, when care receiver M is relying on assistance device 1, regardless of their physique, second load b in a rearwards direction is larger than first load a in forwards direction. In other words, subtraction value FR depends on the ratio of the load in the forwards and rearwards directions on body supporting member 5.

Effort level converting section 722 converts subtraction value FR into effort level corresponding value D (%) using predetermined set lower limit threshold value Th and effort level maximum width Wmax. Lower limit threshold value Th corresponds to a subtraction value FR for which care receiver M does not use their own leg power at all. When subtraction value FR is equal to or less than lower limit threshold value Th, care receiver M can be determined to be not using their own leg power at all. Effort level maximum width Wmax corresponds to the difference between lower limit threshold value Th and subtraction value FR set to effort level 100%. That is, effort level maximum width Wmax is the range of subtraction value FR from effort level 0% to 100%. It is desirable for effort level maximum width Wmax to be determined based on tests performed in advance.

Effort level converting section 722 calculates effort level corresponding value D based on subtraction value FR according to equation (1). Lower limit threshold value Th, for example, is set to −180, and effort level maximum width Wmax is set to 400.

Equation 1: $F=(FR+Th)/W\max\times 100$ (1)

Calculating section 723 acquires first load a and second load b. Calculating section 723 calculates the sum of first load a and second load b as sum value Sum. Sum value Sum corresponds to the power with which assistance device 1 supports care receiver M.

Effort level reference data calculating section 724 calculates effort level reference data Da that represents the extent to which care receiver M uses their own leg power in the period from the start until the end of standing assistance. In detail, effort level reference data calculating section 724 calculates effort level reference data Da based on effort level corresponding value D and sum value Sum.

Here, for example, directly after the start of standing assistance, that is, from the posture with the buttocks of care receiver M contacting the seat surface of the seat, to the posture when the buttocks of care receiver M have completed separated from the seat surface of seat C, normally, first load a and second load b will increase gradually. That is, during this period, the supporting force of assistance device 1 increases. Also, when sum value Sum is small, operation can be performed without care receiver M using their own leg power much. Here, effort level reference data calculating section 724 performs assistance using sum value Sum with respect to effort level corresponding value D acquired from subtraction value FR. Here, effort level reference data calculating section 724 calculates effort level reference data Da in accordance with equation (2).

Equation 2: $Da=a\times Da$ (2)

Figure 6:
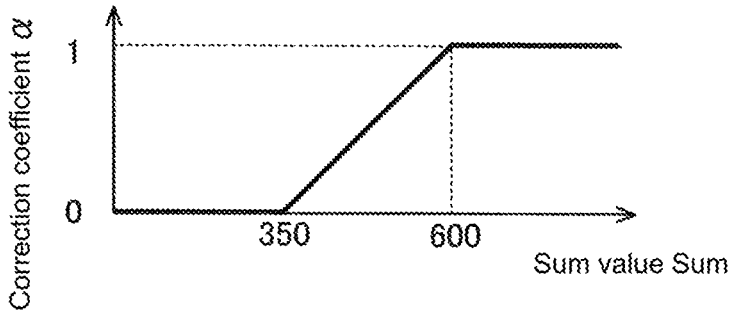
FIG. 6 shows the relationship between correction coefficient $\alpha$ and sum value Sum based on the calculation of effort level reference data Da.

Here, correction coefficient α is as shown in FIG. 6. That is, correction coefficient α depends on sum value Sum. Correction coefficient α is taken as zero equal to or lower than a lower limit (for example, 350), and is taken as one equal to or greater than an upper limit value (for example, 600), and increases between the lower limit and the upper limit. In FIG. 6, correction coefficient α increases in a straight line between the lower limit and the upper limit.

That is, for effort level reference data Da, effort level corresponding value D is corrected to zero when equal to or less than the lower limit value (350), and effort level corresponding value D is not changed when equal to or greater than the upper limit value (600). Also, with effort level reference data Da, effort level corresponding value D is converted at a corresponding ratio between the lower limit value (350) and the upper limit value (600).

Effort level determining section 725 determines first effort level Da, second effort level Da_max, and third effort level Da_ave based on effort level reference data Da. First effort level Da is effort level reference data Da as is. That is, first effort level Da is the effort level reference data representing to what extent care receiver M is using their own leg power as is for the entire period from the start until the end of standing assistance. Second effort level Da_max is a maximum value of effort level reference data Da for a single or multiple instances of standing assistance. Third effort level Da_ave is an average value of effort level reference data Da for a single or multiple instances of standing assistance.

Memory device 73 memorizes first effort level Da, second effort level Da_max, and third effort level Da_ave, as well as subtraction value FR. Memory device 73 memorizes information of Da, Da_max, and Da_ave linked to the care receiver M.

Control device 71 is provided with a control device that stops standing assistance if first effort level Da becomes equal to or less than a threshold value during the standing assistance. Control device 71, for example, if first effort level Da falls to 5% or less, determines that care receiver M is not using their own leg power and stops standing assistance. In this manner, assistance device 1 encourages care receiver M to use their own leg power.

Display device 8 suitably displays first effort level Da, second effort level Da_max, third effort level Da_ave, and subtraction value FR memorized on memory device 73 via a display screen. Details of the display screen of display device 8 are described later.

Details of Each Type of Information During Standing Assistance

Figure 7:
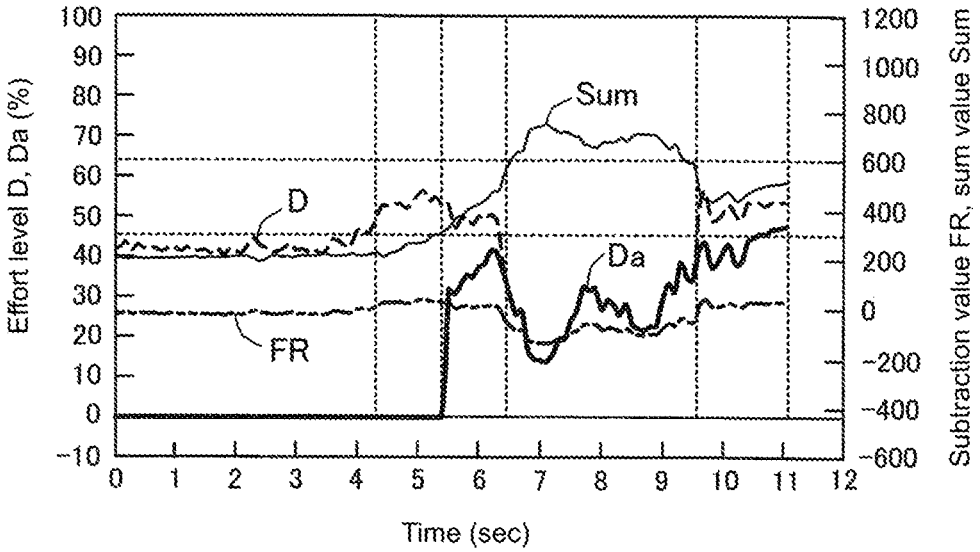
FIG. 7 shows trends in various pieces of information as care receiver M uses their own leg power.
Figure 8:
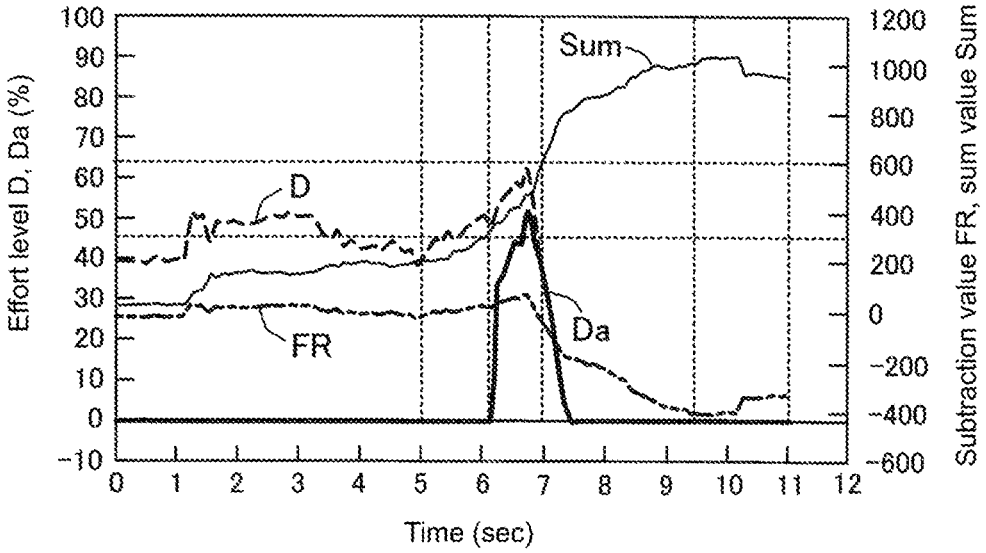
FIG. 8 shows trends in various pieces of information when care receiver M does not use their own leg power.
Figure 9:
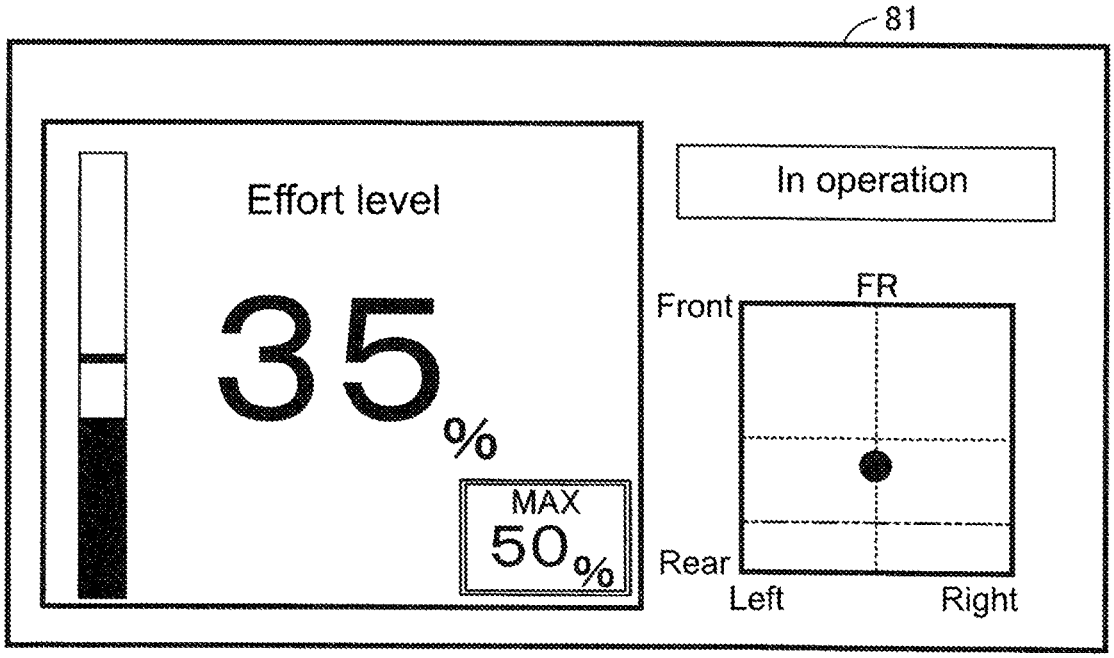
FIG. 9 shows first display screen 81 of display device 8.

Each piece of information calculated by effort level calculating device 72 will be described with reference to FIGS. 7 and 8 comparing cases in which care receiver M does and does not use their own leg power. FIG. 7 shows trends in various pieces of information during standing assistance with care receiver M using their own leg power. On the other hand, FIG. 8 shows trends in various pieces of information during standing assistance with care receiver M not using their own leg power.

Here, as shown in FIG. 7, standing assistance starts at around 4.3 seconds, entering the standing preparation state at which the buttocks of the care receiver separate from the seat surface of seat C at around 5.4 seconds, and finishing at 11 seconds. As shown in FIG. 8, standing assistance starts at around 5 seconds, entering the standing preparation state at which the buttocks of the care receiver separate from the seat surface of seat C at around 6.1 seconds, and finishing at 11 seconds.

As shown in FIG. 7, subtraction value FR is around zero for 0 to 4 seconds, then becomes slightly positive, then changes to be negative, before returning to be positive again. The minimum value of subtraction value FR is around −100. In this case, effort level reference data Da has an offset relationship with respect to subtraction value FR. Sum value Sum is around 200 until around 4.3 seconds, then steadily becomes larger following the start of standing assistance at around 4.3 seconds, reaching 350 at 5.4 seconds in the standing preparation state, then reaching 600 at 6.5 seconds, before falling below 600 by 9.6 seconds.

Correction coefficient α based on sum value Sum is zero at 5.4 seconds, between zero and one from 5.4 to 6.5 seconds and from 9.6 seconds onwards, and is one from 6.5 to 9.6 seconds. Thus, effort level reference data Da is zero until 5.4 seconds in the standing preparation state, then steadily becomes larger, then gets smaller matching effort level corresponding value D from 6.5 to 9.6 seconds, before increasing from 9.6 seconds until standing assistance ends.

On the other hand, as shown in FIG. 8, subtraction value FR is around zero for 0 to 5 seconds, then becomes slightly positive, then changes suddenly to be negative, remaining negative until the end of standing assistance. Here, the minimum value of subtraction value FR is lower than −400. In this case, effort level reference data Da has an offset relationship with respect to subtraction value FR. Sum value Sum is around 200 until around 5 seconds, then steadily becomes larger following the start of standing assistance at around 5 seconds, reaching 350 at 6.1 seconds in the standing preparation state, then reaching 600 at 7 seconds, maintaining a large value until the end of standing assistance.

Correction coefficient α based on sum value Sum is zero at 6.1 seconds, between zero and one from 6.1 to 7 seconds, and is one from 7 seconds onwards. Thus, effort level reference data Da is zero until 6.1 seconds in the standing preparation state, then steadily becomes larger, drops rapidly around 6.8 seconds, becoming zero from 7.4 seconds onwards.

We can see from FIGS. 7 and 8 that effort level reference data Da, that is, first effort level Da represents to what extent care receiver M is using their own leg power during standing assistance by assistance device 1.

Display Screen of Display Device 8

The display screen of display device 8 is described next with reference to FIGS. 9 to 12. The current first effort level Da is shown in large characters in the left frame of first display screen 81 shown in FIG. 9, along with a graph showing how the value is changing. Also, the maximum value of effort level reference data Da during the current standing assistance is displayed in small characters in the bottom right of the left frame, with this maximum level also being indicated on the graph.

Further, the current subtraction value FR is represented by a dot with the frame on the right side of first display screen 81. The center of the frame (the intersection of the dotted lines) is the position at which subtraction value FR is zero. For the upper part of the frame, first load a is larger than second load b, that is, the load is towards the front side. For the lower part of the frame, second load b is larger than first load a, that is, the load is towards the rear side. The two-dashed broken line in the frame corresponds to lower limit threshold value Th. Also, the box in the upper right of first display screen 81 displays in operation or stopped to show the current operational state of assistance device 1. From first display screen 81 shown in FIG. 9 it is possible for a caregiver or care receiver M to understand the current first effort level Da, the current subtraction value FR, and so on.

Figure 10:
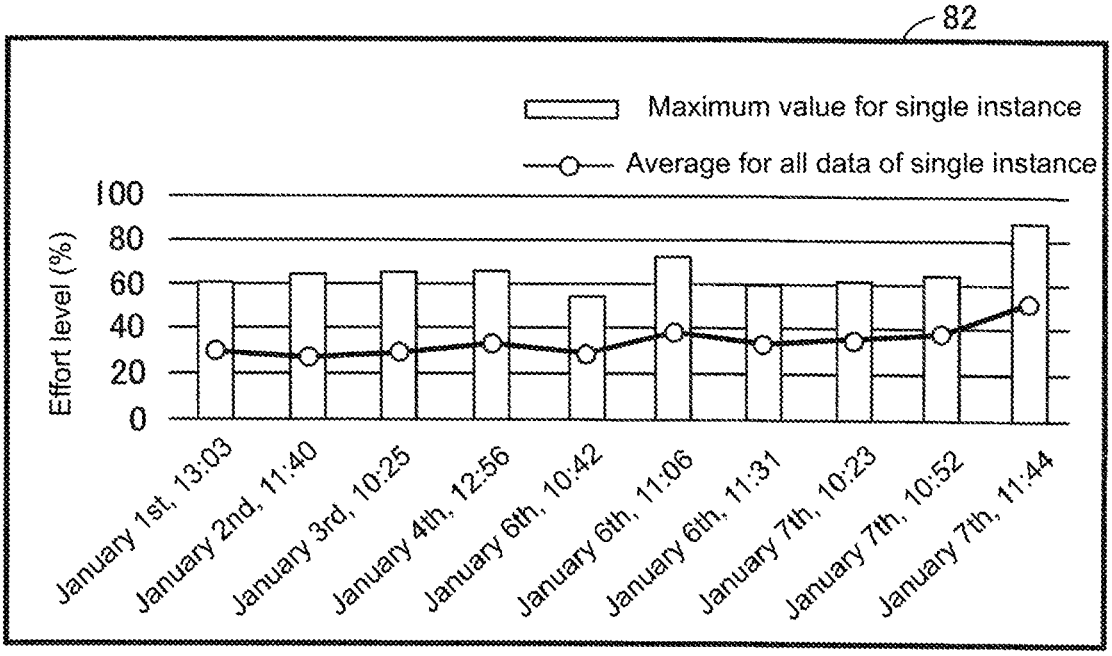
FIG. 10 shows second display screen 82 of display device 8.

Second display screen 82 shown in FIG. 10 shows the trend of the effort level based on each standing assistance operation. In FIG. 10, second display screen 82 shows multiple instances of second effort level Da_max and third effort level Da_ave for each standing assistance operation. A single instance of second effort level Da_max, that is, the maximum value of effort level reference data Da for a single instance of standing assistance, is displayed in a bar graph. A single instance of third effort level Da_ave, that is, the average value of effort level reference data Da for a single instance of standing assistance, is shown by a circle on a line graph. From second display screen 82 shown in FIG. 10 it is possible for a caregiver or care receiver M to understand the trends until now of effort levels Da_max and Da_ave.

Figure 11:
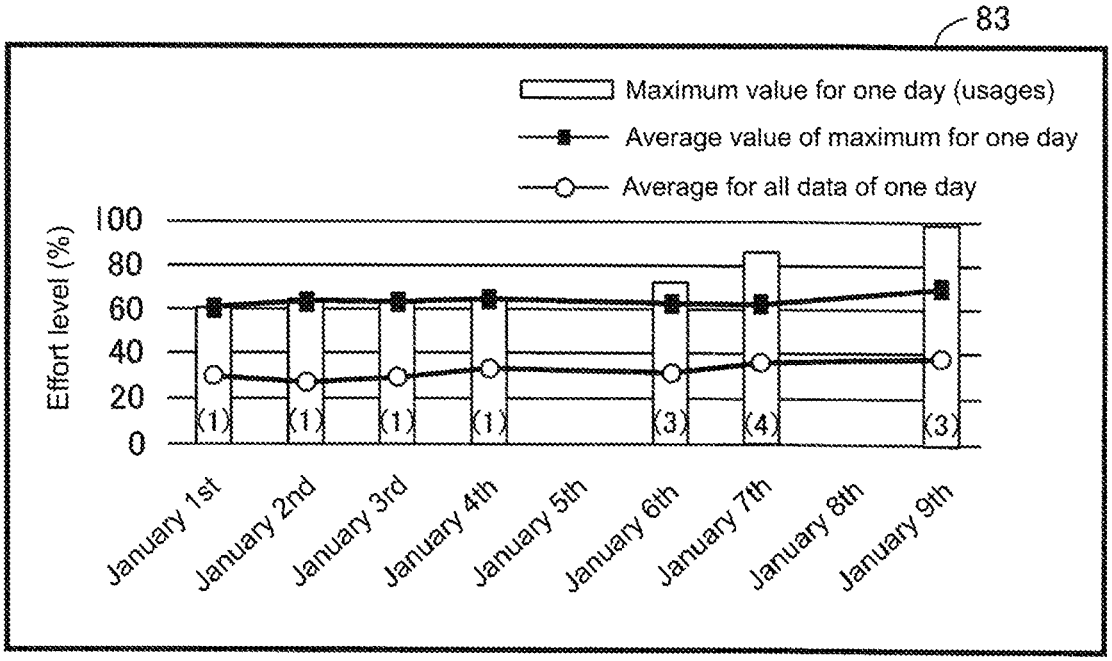
FIG. 11 shows third display screen 83 of display device 8.

Third display screen 83 shown in FIG. 11 shows how the effort level changes by day. In FIG. 10, third display screen 83 shows multiple days' worth of an entire day of second effort level Da_max, an entire day of the average of second effort level Da_max, and an entire day of third effort level Da_ave. An entire day of second effort level Da_max, that is, the maximum value of effort level reference data Da for an entire day of standing assistance, is displayed in a bar graph. The average of second effort level Da_max for the day is also shown by a square on a line graph.

Further, third display screen 83 displays an entire day of third effort level Da_ave, that is, the average value of effort level reference data Da for an entire day of standing assistance, shown by a circle on a line graph. Also, the number of usages is displayed in brackets on third display screen 83. From the third display screen shown in FIG. 11 it is possible for a caregiver or care receiver M to understand the trends until now of effort levels Da_max and Da_ave.

Figure 12:
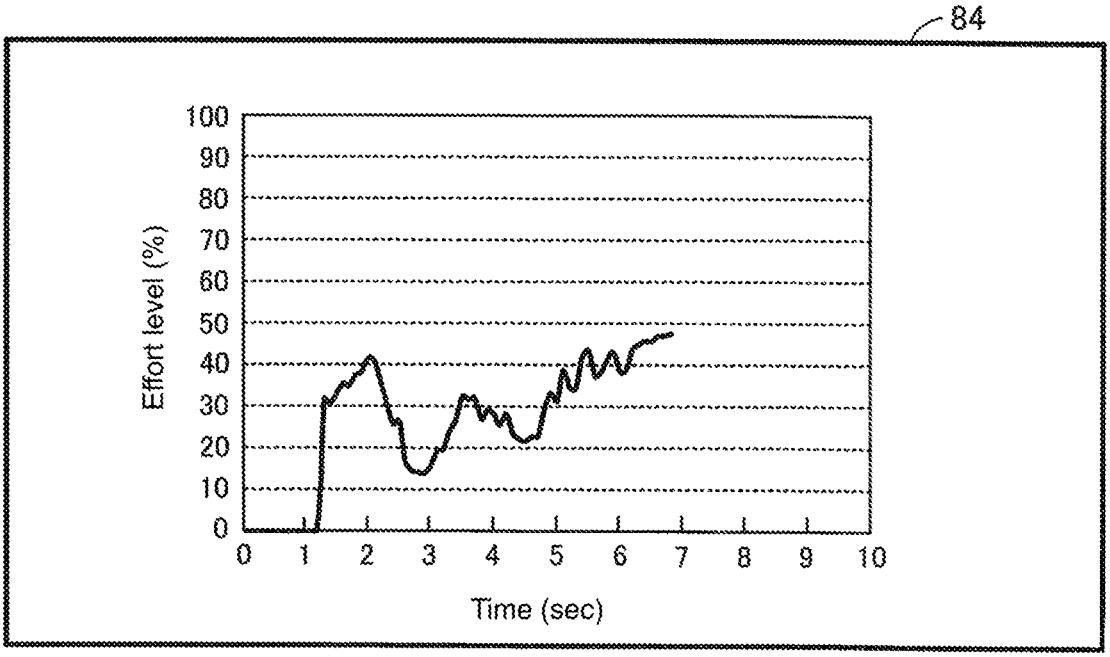
FIG. 12 shows fourth display screen 84 of display device 8.

The trend of first effort level Da for a single instance of standing assistance is shown in fourth display screen 84 shown in FIG. 12. In FIG. 12, the horizontal axis is time and the vertical axis is first effort level Da. In FIG. 12, time zero on the horizontal axis is the time at the start of standing assistance. From fourth display screen 84 shown in FIG. 12 it is possible for a caregiver or care receiver M to understand the changes in first effort level Da during a single instance of standing assistance. First effort level Da for multiple instances of standing assistance may be displayed at the same time on fourth display screen 84.

Effects of Embodiments

Assistance device of the present embodiment supports the upper body of care receiver M and assists care receiver M to stand up. Assistance device 1 is provided with: base 2; a body supporting member 5 provided on base 2 in a manner capable of being raised and lowered, and configured to support the upper body of care receiver M; first load detecting apparatus 61 provided on body supporting member 5, and configured to detect first load a applied by care receiver M; second load detecting apparatus 62 provided on body supporting member 5 at a position rearwards of first load detecting apparatus 61, and configured to detect second load b applied by care receiver M; and effort level calculating device 72 configured to calculate effort levels Da, Da_max, and Da_ave representing to what extent care receiver M is using their own leg power during the standing assistance based on a relationship between first load a and second load b.

Effort level calculating device 72 calculates effort level Da, Da_max, and Da_ave of care receiver M based on a relationship between first load a and second load b. A caregiver or care receiver M is able to understand a way in which load is applied in the front-rear direction of body supporting member 5 from first load a and second load b. For example, a way in which load is applied may be a load towards the front, a load towards the rear, a load balanced between the front and rear, and so on.

Here, with respect to a way in which load is applied in the front-rear direction of body supporting member 5, in a case in which the extent to which care receiver M is using their own leg power (effort levels Da, Da_max, and Da_ave) is high, the ratio of the body weight of care receiver M supported by their own legs increases, therefore, the rear-side load on the body supporting member decreases, and the load is a forward load. Conversely, with respect to a way in which load is applied in the front-rear direction of body supporting member 5, in a case in which the extent to which the care receiver is using their own leg power (effort levels Da, Da_max, and Da_ave) is low, the ratio of the body weight of care receiver M supported by their own legs decreases, therefore, the rear-side load on the body supporting member increases, and the load is a rearward load.

The relationship between this way in which a load is applied on body supporting member 5 in the front-rear direction and the dependency level of care receiver M on assistance device 1 shows a similar trend regardless of differences in physiques of care receivers M. In other words, the effort levels Da, Da_max, and Da_ave calculated based on first load a and second load b indicate an appropriate evaluation as to what extent care receiver M used their own leg power.

Assistance device 1 is also provided with raising and lowering member 31 provided on base 2 capable of being raised and lowered. Body supporting member 5 is provided on raising and lowering member 31 to be tiltable in a front-rear direction and supports the upper body of care receiver M. In this manner, by having a configuration in which body supporting member 5 tilts in the front-direction on raising and lowering member 31, effort level calculating device 72 is able to reliably understand the effort level of care receiver M based on the relationship between first load a and second load b.

In detail, effort level calculating device 72 calculates effort levels Da, Da_max, and Da_ave based on the difference (subtraction value FR) between first load a and second load b as the relationship between first load a and second load b. In a case in which care receiver M is using their own leg power, regardless of their physique, first load a in a forwards direction is larger than second load b in a rearwards direction. On the other hand, when care receiver M is relying on assistance device 1, regardless of their physique, second load b in a rearwards direction is larger than first load a in forwards direction. The size relationship between first load a and second load b can be known from the difference between first load a and second load b. Therefore, effort level calculating device 72 calculates the effort levels Da, Da_max, and Da_ave calculated based on first load a and second load b such that it is possible to appropriately evaluate to what extent care receiver M used their own leg power.

In detail, effort level calculating device 72 calculates effort level Da, Da_max, and Da_ave based on the difference between first load a and second load b (subtraction value FR) and the sum of first load a and second load b (sum value Sum) as the relationship between first load a and second load b.

Sum value Sum corresponds to the power with which assistance device 1 supports care receiver M. Directly after the start of standing assistance, that is, from the posture with the buttocks of care receiver M contacting the seat surface of seat C, to the posture when the buttocks of care receiver M have completed separated from the seat surface of seat C, normally, first load a and second load b will increase gradually. That is, during this period, the supporting force of assistance device 1 increases. Also, when sum value Sum is small, operation can be performed without care receiver M using their own leg power much. Here, effort level calculating device 72, by performing correction using sum value Sum in addition to subtraction value FR, for example, directly after the start of standing assistance, is able to acquire effort levels Da, Da_max, and Da_ave representing an appropriate evaluation as to what extent care receiver M used their own leg power.

Also, effort level reference data calculating section 724 calculates effort level reference data Da that represents the extent to which care receiver M uses their own leg power in the period from the start until the end of standing assistance. And, effort level determining section 725 determines the maximum value of effort level reference data Da during a single or multiple instances of standing assistance as second effort level Da_max.

During a single instance of standing assistance, care receiver M uses their own leg power at various different times. Thus, second effort level Da_max is one representation of an effort level, that is, a maximum value of effort level reference data Da for a single or multiple instances of standing assistance. The maximum value is the value at which care receiver was making most effort during the operation period. Therefore, even if the timing at which care receiver M uses their own leg power during a series of standing movements varies, it is possible to reliably evaluate to what extent care receiver M used their own leg power during the series of standing movements.

Also, effort level determining section 725 determines the average value of effort level reference data Da during a single or multiple instances of standing assistance as third effort level Da_ave. During a single instance of standing assistance, care receiver M uses their own leg power at various different times. Thus, second effort level Da_ave is one representation of an effort level, that is, an average value of effort level reference data Da for a single or multiple instances of standing assistance. The average value represents to what extent care receiver M made effort over the entire operation period. Therefore, even if the timing at which care receiver M uses their own leg power during a series of standing movements varies, it is possible to reliably evaluate to what extent care receiver M used their own leg power during the series of standing movements.

Also, effort level determining section 725 determines effort level reference data Da that represents the extent to which care receiver M uses their own leg power in the entire period from the start until the end of standing assistance as first effort level Da. During a single instance of standing assistance, care receiver M uses their own leg power at various different times. Here, effort level reference data Da for the entire period from the start until the end of standing assistance is determined as first effort level Da. Thus, it is possible to better understand at what point to what extent care receiver M used their own leg power.

Also, assistance device 1 is provided with display device 8 that displays effort levels Da, Da_max, and Da_ave. By this, care receiver M or a caregiver is able to easily understand effort levels Da, Da_max, and Da_ave of care receiver M.

Also, control device 71 of assistance device 1 stops standing assistance if first effort level Da becomes equal to or less than a threshold value (corresponding to a case in which subtraction value FR is equal to or less than lower limit threshold value Th) during the standing assistance. In this manner, by control device 71 stopping standing assistance when first effort level Da is equal to or less than a threshold value, care receiver M is encouraged to use their own leg power.

Assistance device 1 of the present embodiment includes: base 2; body supporting member 5 provided on base 2 in a manner capable of being raised and lowered, and configured to support the upper body of care receiver M; load detecting device 6 configured to detect a load applied on body supporting member 5 by care receiver M; and an effort level calculating device 72 configured to calculate effort level reference data Da for a specified period representing to what extent care receiver M is using their own leg power during the standing assistance based on the load, and calculate a maximum value of effort level reference data Da as the effort level (second effort level Da_max). Accordingly, it is possible to understand the effort level of care receiver M for the time at which they maximized use of their own leg power during a specified period.

In the present embodiment, load detecting device 6 is attached to torso support member 51 and is provided with first load detecting apparatus 61 and second load detecting apparatus 62 that detect pressure. Further, load detecting device 6 is able to detect a load applied on torso support member 51 based on the load applied to a drive device for driving torso support member 51.

Above, the specified period, for example, is the entire period from the start until the end of standing assistance during a single or multiple instances of standing assistance. In other words, effort level calculating device 72, based on the load during standing assistance, calculates effort level reference data Da during the entire period from the start until the end of standing assistance, and calculates the maximum value of effort level reference data Da during a single or multiple instances of standing assistance as the effort level (second effort level Da_max).

REFERENCE SIGNS LIST

1: assistance device;
2: base;
3: raising and lowering section;
4: oscillating section;
5: body supporting member;
6: load detecting device;
8: display device;
31: raising and lowering member;
32: raising and lowering drive section;
41: oscillating member;
42: oscillating drive section;
51: torso support member;
52: underarm support member;
61: first load detecting apparatus;
62: second load detecting apparatus;
71: control device;
72: effort level calculating device;
73: memory device;
a: first load;
b: second load;
Da, Da_max, Da_aAVe: effort level;
Da: effort level reference data;
FR: subtraction value;
Sum: sum value;
Th: lower limit threshold;
M: care receiver

The invention claimed is:

1. An assistance device for supporting an upper body of a care receiver and performing standing assistance for the care receiver, the assistance device comprising:

a base;

a body supporting member provided on the base to be raised and lowered relative to the base, and configured to support the upper body of the care receiver, the body supporting member including a torso support member and an underarm support member;

a first load detecting device provided on the body supporting member, and configured to detect a first load applied by the care receiver;

a second load detecting apparatus provided on the body supporting member at a position below and rearwards of the first load detecting device, and configured to detect a second load applied by the care receiver; and an effort level calculating device configured to calculate an effort level representing to what extent the care receiver is using their own leg power during the standing assistance based on a relationship between the first load and the second load.

2. The assistance device according to claim 1, wherein the relationship between the first load and the second load is a difference between the first load and the second load.

3. The assistance device according to claim 2, wherein the relationship between the first load and the second load is the difference between the first load and the second load and a sum of the first load and the second load.

4. The assistance device according to claim 1, wherein the effort level calculating device is configured to calculate, during an entire period from starting the standing assistance to ending the standing assistance, effort level reference data representing to what extent the care receiver is using their own leg power, and to determine a maximum value of the effort level reference data during one or multiple cases of the standing assistance as the effort level.

5. The assistance device according to claim 1, wherein the effort level calculating device is configured to calculate, during an entire period from starting the standing assistance to ending the standing assistance, effort level reference data representing to what extent the care receiver is using their own leg power, and to determine an average value of the effort level reference data during one or multiple cases of the standing assistance as the effort level.

6. The assistance device according to claim 1, wherein the effort level calculating device is configured to determine effort level reference data representing to what extent the care receiver is using their own leg power during an entire period from starting the standing assistance to ending the standing assistance as the effort level.

7. The assistance device according to claim 1, further comprising a display device for displaying the effort level.

8. The assistance device according to claim 1, further comprising a raising and lowering member provided on the base in a manner capable of being raised and lowered, wherein the body supporting member is provided on the raising and lowering member in a manner capable of tilting forwards and backwards, and supports the upper body of the care receiver.

9. The assistance device according to claim 8, further comprising an oscillating section provided between the body supporting member and raising and lowering member, the oscillating section configured to oscillate in a front-rear direction with respect to raising and lowering member.

10. The assistance device according to claim 1, further comprising a control device configured to stop the standing assistance in a case in which the effort level is equal to or less than a threshold value during the standing assistance.

11. The assistance device according to claim 1, wherein the first load detecting device and the second load detecting device are provided to the torso support member.

* * * * *